United States Patent [19]

Rogen

[11] 3,967,348

[45] July 6, 1976

[54] BUTTON STRUCTURE

[76] Inventor: Neil E. Rogen, 3 Beaver Dam Road, Upper Saddle River, N.J. 07458

[22] Filed: Oct. 16, 1974

[21] Appl. No.: 515,151

Related U.S. Application Data

[63] Continuation-in-part of Ser. No. 387,390, Aug. 10, 1973, abandoned.

[52] U.S. Cl. ..... 24/90 E; 24/90 PR; 24/90 C; 24/90 F

[51] Int. Cl.[2] ..... A44B 1/34; A44B 1/44

[58] Field of Search ..... 24/90 C, 90 E, 90 F, 24/90 PR, 90 R, 101 R, 108, 208 A, 217; 85/5 R

[56] References Cited

UNITED STATES PATENTS

| | | | |
|---|---|---|---|
| 2,210,799 | 8/1940 | Denny | 24/90 C |
| 2,901,796 | 9/1959 | Hope | 24/90 PR |

FOREIGN PATENTS OR APPLICATIONS

| | | | |
|---|---|---|---|
| 1,922,109 | 11/1969 | Germany | 24/90 PR |
| 718,149 | 10/1966 | Italy | 24/90 PR |

*Primary Examiner*—Bernard A. Gelak
*Attorney, Agent, or Firm*—Abraham Ogman

[57] ABSTRACT

The invention is directed to a button structure which may be easily molded. It may be secured to a garment by hand or by automatic machine. The structure includes a simulated button from which depends a shank. The shank includes a post for spacing the button from the garment, a fastening member which clamps the button to a fabric and a hand detachable point which is used to pierce the fabric.

9 Claims, 3 Drawing Figures

BUTTON STRUCTURE

This applicaton is a Continuation-in-Part of patent application, Ser. No. 387,390 filed Aug. 10, 1973 entitled "Replacement Button Structure," now abandoned.

Buttons disappear or break or drop off garments at the most inopportune times. Replacing the button by conventional means, the needle and thread, is often inconvenient or not possible.

The invention covers a structure which may be conveniently stored in a travel bag, desk or purse. It can be attached to a garment by hand without the aid of needle and thread or any other auxiliary means.

The button structure described and claimed herein may also be used by clothing manufacturers using automated means. Once attached, the button is permanently affixed. It is practically inseparable and durable. The structure is easily adapted to provide style coordination.

The invention is related to the structures described in U.S. Pat. Nos. 842,770; 2,901,796; and 3,389,439.

It is an object of the invention to provide a button structure which avoids the limitations and disadvantages of prior art devices of this type.

Other objects of the invention are to provide a button structure which:

a. provides a fixed clearance between the button and the fabric;

b. avoids the exposure of ragged surfaces;

c. may be applied in a simple and facile manner;

d. includes a simulated button;

e. includes a snap-on fastening means which enables one to use an easily breakable material;

f. includes a two-piece structure with design features that enable both pieces to be made from the same material;

g. is positively clamped to the supporting fabric; and h. is made from a material having a modulus of elasticity that enables the structure to pierce fabrics, have rugged durability and enables the point to be broken off with relative ease; i.e. by bending 30 to 90°.

The novel features that are considered characteristic of the invention are set forth in the appended claims; the invention itself, however, both as to its organization and method of operation, together with additional objects and advantages thereof, will best be understood from the following description of a specific embodiment when read in conjunction with the accompanying drawings, in which:

Figure 1:
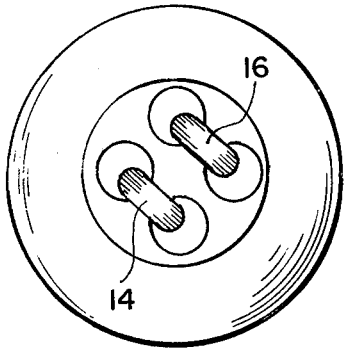
FIG. 1 is a top view of the button structure covered herein.
Figure 2:
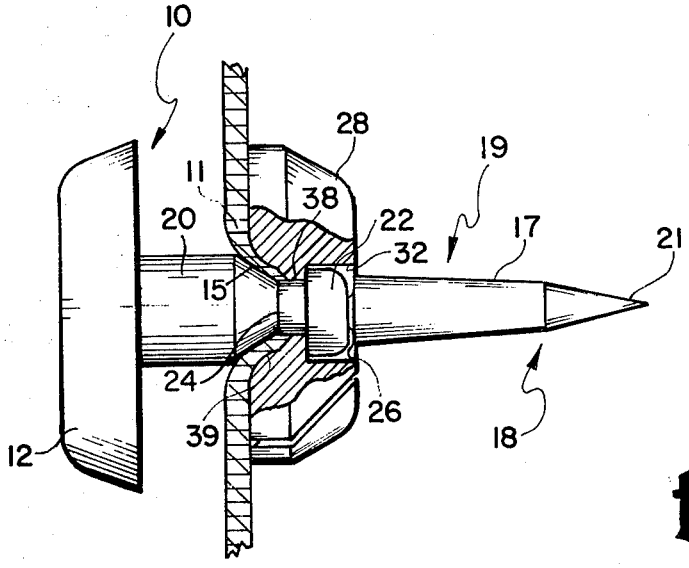
FIG. 2 is a side view of the Figure on structure including a partial section.
Figure 3:
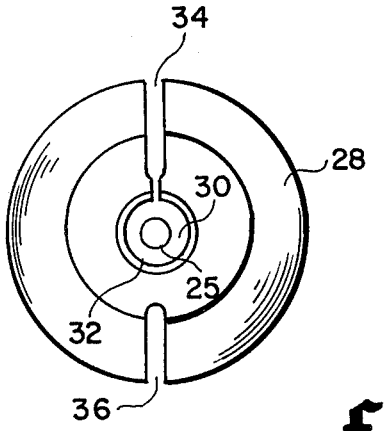
FIG. 3 is a top view of a fastening means.

Referring to FIG. 2 of the drawings, there is depicted a button structure 10 embodying the principles of the invention.

The button structure 10 includes a simulated button 12 which is configured, for illustrative purposes, as a man's shirt button. Any other button configuration may be used, however. The button 12 includes raised portions 14 and 16 to simulate thread. The color can be made to match white pearl for men's shirts, or any other color.

Depending from the button 12 is shank 18 which contains a post 20 that is secured to the button 12. As a practical matter, the button 12 and the shank 18 may constitute a unitary molded structure.

The selected molding material has a modulus of elasticity which enables the user to break the pointed member 19 off by merely bending the point laterally less than 90°. Preferably, a material is chosen which will cause the pointed member 19 to to break in the range of 30° to 60°. Within this range, the material has the requisite stiffness to penetrate the fabric without breaking off prematurely.

The class of materials which satisfy the requirements noted above have an elastic modulus of 300,000 to 600,000. Selected acrylic, polystyrene or acetals are preferred. These parameters are important in that the structure has the required strength and stiffness to enable the button structure to be formed of a reasonable length and diameter.

The post 20 is shown as a cylindrical member terminating in a chamfer 15. However, it may have a square, rectangular or any cross section. Generally, it is an elongated member provided for spacing the button from the supporting fabric 11.

The opposite end of the shank 18 is a detachable pointed member 19 which is designed to pierce and pass through the fabric of a garment. The pointed member 19 is configured to have a first taper 17 in the range of 5° to 10° and a second taper 21 of 25°–35°. This "compound" taper is a preferred construction which greatly simplifies piercing the fabric. The taper 21 provides a sharp, relatively rigid, point and the taper 17 provides a larger more reliable cross section. The pointed member 19, if constructed from a simple taper necessary to pierce the fabric, tends to be less reliable in that it will break off prematurely if a material having a modulus at the high end of the range is used or bend or curve if a material having a modulus at the low end of the range is used. Further, the simple taper construction tends to be longer necessitating the use of more material. The extra length provided by the first taper permits the user to more easily pierce a garment while he is still wearing the garment while holding the button 12 and the fabric in one hand. Because of the extra length of the taper, he can push the button 12 through the fabric with his thumb while supporting the fabric with his second and third fingers. The ratio of the length of taper 21 to that of taper 17 is 1/5 to ⅓.

An intermediate collar 22 is joined to the post 20 and the pointed member 19 by means of two reduced diameter lengths which define first and second grooves 24 and 26, respectively. The first groove 24 is joined to the post 20 by the chamfer 15. This discontinuity designated as the chamfer 15 acts to lock, grip or clamp the button structure to the fabric as will be shown hereafter.

For purposes of simplicity, the discussion will consider circular cross sections of the various members of the shank 18, though it is understood that this is a preferred, but not an absolute requirement.

The diameter—or largest sectional dimension—of the groove 26 is ¼ to ½ of the diameter or the largest sectional dimension-of the pointed member 19 to facilitate the removal of the pointed member by breaking, taking into consideration the modulus of the material as heretofore described.

The collar 22 has a diameter which is no larger than the largest diameter of the pointed member 19. Its diameter, however, is smaller than that of the post 20 in order to provide the clamping action alluded to heretofore. The preferred ratio of the diameter of the post 20 to the collar 22 is 1.3 minimum.

A fastening means 28 is also provided as part of the button structure. The fastening member for ease of manufacture is preferably molded from the same stiff material as the button 12 and shank 18. The fastening means 28 is an annulus disc shaped member which includes a central passage 30 opening into a recess 32. The central passage 30 includes a terminal chamfer 39 which complements the chamfer 15. Preferably, both chamfers are 45° but an acceptable range is 30° to 60°. The recess 32 is deep enough to contain the entire collar 22 and the small stub of the second groove 26 which may result when the pointed member 19 is broken off.

The fastening means 28 also includes a pair of oppositely spaced radial slots 34 and 36. One of the slots 34 extends through the width of the annulus into the passage 30 or nearly through. This feature is provided to enable the passage 30 to be resiliently expanded to fit over the pointed member 19 and the collar 22 to overcome the inherent stiffness and unyielding nature of the material from which it is formed as the passage 30 has a diameter which is about equal to the diameter of the groove 24.

The passage 30 is defined by a lip 38 which is roughly equal to the length of the first groove 24.

The entire assembly of the button structure is about ⅜ to ½ inch long for shirt buttons.

The particular construction of the fastening means 28 is important as it permits the use of an easily breakable, relatively non-yielding material for the shank and, particularly, for the pointed member 19. The use of an easily breakable material enables one to simply break the point off without the need of a scissor, knife or other cutting means. The button may be attached to a garment at any time and any place.

Further, as the collar 22 and the stub are completely contained within the recess 32, there are no ragged surfaces exposed that may snag on fabric or cause discomfort.

The use of the button structure 10 is quite clear. To attach the button structure 10 to a garment, the point of the shank 18 is pressed through the fabric until the fabric is seated in the recess 24 and presses against the chamfer 15. Because the diameter of the post 20 is larger than either of the diameters of the pointed member 19 or the collar 22, the fabric comes to rest in the groove 24. The fastening means 28 is then journaled over the point until the lip 38 is seated in the groove 24 and the chamfer 39 bears against the chamfer 15. The locking means 28 clamps the fabric in the recess 24 and the entire assembly is held in place. The pointed member 19 is then broken off at the groove 26, thus completing the assembly.

The advantages of the structure described above over the prior art are manifold. In the first place, the button is spaced from the fabric surface by the length of the post so that the act of using the button is greatly facilitated. Secondly, the fastening means 32 is constructed to expand slightly so that the shank portion of the button structure may be made from an easily breakable material enabling the structure to be used without auxiliary means. Additionally, there are no ragged or rough edges exposed which could snag on fabric or cause discomfort.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

I claim:

1. A button structure comprising:

a. a simulated button;

b. a shank attached to the simulated button having an elongated post attached to said button, a pointed portion on the opposite end of said shank and an intermediate collar joined to said post and said pointed portion by reduced cross sections forming first and second grooves respectively, said post having an enlarged cross section relative to the collar and pointed portion, said pointed portion being adapted to be broken off at said second groove; and c. an essentialy annular fastening member having an enlarged recess for containing said collar, terminating in an inwardly protruding lip defining a concentric passage having a diameter smaller than said collar and said post, a pair of oppositely spaced radial slots extending inwardly from the edge of the fastening member, one slot extending to said passage and recess whereby said passage may be resiliently opened and closed to fit over said collar, said lip having a thickness which is substantially equal to the length of the first groove whereby fabric is adapted to be clamped in said first groove by said lip.

2. A button structure as defined in claim 1 wherein the wall interface between the post and the groove is a first chamfer and said passage in said fastening member opens outwardly toward the exterior surface in a complementary chamfer to said first chamfer.

3. A button structure as defined in claim 1 wherein the largest radial dimension of said post is at least 1.3 times the largest radial dimension of said collar.

4. A button structure as defined in claim 1 wherein said button and shank is an integral molded structure, said button shank and fastening member are made from the same material and having a modulus of elasticity in the range of 3 to 5 × $10^5$ psi.

5. A button structure as defined in claim 1 wherein said pointed member is defined by a compound taper of 5°–10° extending from the second groove to an intermediate position and 25° to 35° from the intermediate position to said point.

6. A button structure as defined in claim 5 wherein the ratio of the length of the 25° to 35° taper to said 5° to 10° taper is 1/5 to ⅓ percent.

7. A button structure as defined in claim 1 wherein said shank is circular in cross section and the diameter of the button of the second groove to the diameter of the adjacent edge of said pointed portion is ¼ to ½.

8. A button structure as defined in claim 6 wherein said shank is circular in cross section and the diameter of the button of the second groove to the diameter of the adjacent edge of said pointed portion is ¼ to ½.

9. A molded button structure as defined in claim 4, wherein:

a. said pointed member includes a compound taper of 5°–10° extending from the second groove to an intermediate position and 25° to 35° from the intermediate position to said point and the ratio of the length of the 25° to 35° taper to said 5° to 10° taper is 1/5 to ⅓ percent; and b. said shank is circular in cross section and the diameter of the button of the second groove to the diameter of the adjacent edge of said pointed portion is ¼ to ½.

* * * * *